United States Patent [19]

Gikas

[11] Patent Number: 4,510,952

[45] Date of Patent: Apr. 16, 1985

[54] HAIR TREATING ARTICLE AND A METHOD OF ITS USE

[75] Inventor: Giorgos X. Gikas, Washington, D.C.

[73] Assignee: The Gillette Company, Boston, Mass.

[21] Appl. No.: 380,156

[22] Filed: May 20, 1982

[51] Int. Cl.[3] ..... A45D 2/24

[52] U.S. Cl. ..... 132/37 R; 132/33 R; 132/40

[58] Field of Search ..... 132/7, 37 R, 33 R; 424/70-71

[56] References Cited

U.S. PATENT DOCUMENTS 2,895,486 7/1959 Sayer ..... 132/9
3,954,113 5/1976 Bohrer ..... 132/7
4,236,540 12/1980 Takagi ..... 132/33 R

FOREIGN PATENT DOCUMENTS 29683 3/1973 Japan ..... 132/88.5

*Primary Examiner*—Gregory E. McNeill
*Attorney, Agent, or Firm*—Leonard J. Janowski

[57] ABSTRACT

A flexible tubular sleeve for use in conjunction with a source of heat for the application of a treating composition to the hair, said sleeve comprising an inner layer of a liquid impermeable material and an outer reservoir layer, said reservoir layer being impregnated with a hair treating composition having a melting point of about 22°-100° C.

7 Claims, No Drawings

HAIR TREATING ARTICLE AND A METHOD OF ITS USE

BACKGROUND OF THE INVENTION

We have discovered that hair treating materials such as conditioning or setting agents can be applied to the hair at the same time that tresses are being heat set by using, in conjunction with a conventional heated curling rod, iron, curler or other hair curling device, a flexible tubular sleeve which has been coated or impregnated with a hair treating agent. The sleeve is adapted to fit snugly over the heated portion of the curling iron and has an impermeable barrier layer between the hair treating agent and the curling iron to prevent deposition of the material on the heated surface during use.

Hair treating materials such as conditioning agents and setting agents have in the past been applied to hair in a variety of ways. Probably the most common way has involved the application of liquid or semi-solid compositions directly to the hair as a separate step between the shampooing process and the setting process.

There have been attempts in the past to combine the application of hair treating compositions and the setting process. These attempts are exemplified by U.S. Pat. No. 3,003,505 describing a foam hair setting roller impregnated with a hair waving agent which is activated by dipping in water before use. In similar fashion U.S. Pat. No. 3,910,290 describes a paperboard roller having an outer layer of embossed metal foil bearing a dry film coating of a water soluble hair treating agent which is activated by dipping in water. In similar vein is the teaching of U.S. Pat. No. 3,108,604 dealing with a corrugated paperboard cylinder coated with a water soluble hair treating agent.

In contrast with the above patents, which deal generally with hair treating agents activated by contact with water are teachings in the art involving the application of treating materials to the hair during a waving or setting process employing heat. Representative is the teaching of Belgian Pat. No. 513,943 in which lanolin-impregnated end tissues are used with hot waving pads.

A variation of the above is shown in U.S. Pat. No. 3,766,930 disclosing a heatable, vapor-applying hair curler having a heat storage body, a liquid reservoir surrounding the body, and an outer casing having perforations therein which allow a vaporized liquid to be emitted from the reservoir when the body is heated.

Although not directly related to the treatment of human hair, there is a body of prior art dealing with the application of treating compositions to laundry by commingling articles of damp clothing and a flexible substrate carrying a conditioning agent by tumbling them under heat in a laundry dryer to effect transfer of the conditioning agent to the clothing while it is being dried. This type of technology is described in, for example, U.S. Pat. No. 3,442,692. The use of impregnated flexible substrates to apply normally solid hair conditioning agents to the hair is disclosed in U.S. Pat. Nos. 4,149,551; 4,206,195; 4,206,196; and 4,296,783.

It is an object of this invention to provide an article and a method for treating hair employing a tubular substrate and a hair treating agent.

A further object of the invention is to provide an article and method for treating the hair while simultaneously setting it by using a tubular article having releasably associated therewith a normally solid hair treating agent.

A still further object of this invention is to provide such an article and method to be used in conjunction with a source of heat for setting the hair.

These and other objects of the invention will become apparent from the description to follow.

SUMMARY OF THE INVENTION

The article used in the practice of this invention comprises a flexible tubular sleeve adapted to fit over the heated rod portion of a conventional hair curling iron or a heated roller or other heated hair curling device. The article comprises an inner layer of a liquid impermeable material such as a synthetic polymer film or metallic foil and an outer reservoir layer of a woven or non-woven textile material or synthetic polymer foam. The reservoir layer is impregnated with a hair treating composition such as a conditioning or setting agent which is normally solid at room temperature but which is capable of melting at a temperature below the temperature of the surface of the curling iron.

The method of use of the article involves placing the tubular sleeve over the heated rod and then using the curling iron to set tresses of hair in the conventional manner. As the curling iron is manipulated to wrap a tress of hair about the heated rod, the hair treating agent melts and is drawn into the wrapped tress by capillary action. As many as 30 or more tresses of hair may be treated while setting using a single sleeve.

DETAILED DESCRIPTION OF THE INVENTION

The tubular sleeve used in the practice of our invention requires the presence of two features. It must employ a reservoir to hold the solid hair treating agent which is melted by the curling iron during use, and it must also employ a liquid impervious layer between the reservoir and the heated curling rod itself to prevent wicking of the melted material and contact with the heated rod with the possibility of chemical decomposition.

The reservoir material may comprise a cloth substrate, either non-woven or woven, or, preferably, an absorbent, spongy material.

The non-woven cloth substrates used in the invention herein are generally defined as adhesively bonded fibrous or filamentous products having a web or carded fiber structure (where the fiber strength is suitable to allow carding), or comprising fibrous mats in which the fibers or filaments are distributed haphazardly or in random array (i.e., an array of fibers in a carded web wherein partial orientation of the fibers is frequently present, as well as a completely haphazard distributional orientation), or substantially aligned. The fibers or filaments can be natural (e.g. wool, silk, jute, hemp, cotton, linen, sisal, wood cellulose or ramie) or synthetic (e.g. rayon, cellulose ester, polyvinyl derivatives, poly-olefins, polyurethanes, polyamides, or polyesters) or fiber blends with a basis weight from 10 to 210 grams per square meter.

Woven cloths which may be used include the single or double knit cloths made from natural fibers, (e.g. cotton or wool) synthetic fibers (e.g. rayon, polypropylene or polyester) or fiber blends (e.g. a cotton/polyester blend). Such cloths may have a basis weight from 23 to 240 grams per square meter.

The reservoir materials which we prefer to use, the absorbent spongy materials may be described as reticulated or non-reticulated flexible, cellular synthetic polymer foams. Among such materials, we especially prefer reticulated or non-reticulated flexible polyether or polyester types of polyurethane foam.

The dimensions of the tubular sleeve are dictated in part by the type of curling iron with which the invention is to be used. Conventional curling irons which are heated electrically or by the combustion of a fuel such as butane generally employ a heated rod ranging in diameter from 12 mm. to 38 mm. The smaller diameter appliances are generally employed when it is desired to produce a tighter curl result while the larger diameter appliances produce a correspondingly looser and more casual result. The inside diameter of the tubular sleeve of this invention wil fall within approximately the same range of dimensions since it is preferred that the sleeve be sized to fit snugly over the heated rod to permit the hair tress to be readily wound and also to provide for efficient heat transfer from the rod to the hair. The length of the tubular article is likewise dictated by the length of the heated rod with which it is intended to be used. This may vary from as long as 15 cm. to as little as 3 cm. Taking into consideration the amount of hair that is usually included in a typical tress to be curled with a heated curling iron, we prefer to use a sleeve having a length of from 5 to 11 cm.

The thickness of the reservoir layer may vary from 2 to 250 mils with a preferred range of 50–130 mils. An advantage in using tubular sleeves having relatively thin reservoir layers is that little additional diametrical thickness is added to the heated curling rod, thus permitting a tighter curl result in use. Where tubular sleeves having relatively thicker reservoir layers are employed, not only is a somewhat looser curl result produced but a longer time is required to heat the mass of hair treating agent to its melting point. An advantage in using thicker reservoir layers lies in the fact that, due to the presence of a larger quantity of hair treating agent, a larger number of tresses can be treated using a single sleeve.

The impermeable layer which serves to separate the reservoir from the surface of the curling iron rod may be made from any material which will be impervious to the melted hair treating agent and which, in addition, is stable at the temperature of the surface of the heated curling rod which may be in excess of 160° C. Materials which may be employed for this purpose include synthetic polymer films such as a polyethylene terephthalate film having, for example, a thickness of 0.25 to 14 mils; metal foils such as aluminum foil having a thickness of 0.18 to 115 mils; or a paper such as Kraft paper having a heat sealed synthetic polymer coating to render it impervious. While specific material thicknesses have been mentioned above, a wide range of thicknesses may be employed depending upon the material employed and the degree of rigidity desired in the tubular sleeve, bearing in mind that thermal conductivity from the heated rod to the wrapped tress is a function, in part, of the material chosen and its thickness.

Where a thermoplastic polymer foam such as polyurethane has been employed as a reservoir material, it is possible to dispense with a separate impermeable layer to prevent migration of melted hair treating agent to the heated curling rod surface. An impermeable barrier or skin can be created or formed by sealing the surface of the foam which forms the inner surface of the tubular sleeve. Such sealing or skin forming can be conveniently accomplished by sintering the foam surface to destroy the cellular structure and render the surface smooth, impermeable and free from cellular inclusions.

The need for a separate impermeable layer can also be avoided by using a non-reticulated foam such as a polyurethane as the reservoir material. A possible disadvantage in using either a heat sealed reticulated foam or a non-reticulated foam without a separate impermeable inner sleeve layer is that if pin holes or imperfections exist in the foam or skin structure, the melted hair treating agent will migrate or wick to the heated curling rod surface.

The hair treating composition contained within the reservoir layer may comprise any of a wide variety of known setting or conditioning materials which are solid at room temperature but which are capable of being melted when used as taught herein in conjunction with a conventional heated curling iron. We wish to include any such treating composition having a melting point between 22° and 100° C.

Among the materials which may be employed are a wide variety of natural and synthetic waxes, as well as a wide variety of cationic, nonionic, anionic, zwitterionic, and amphoteric surface active agents or mixtures thereof.

Among the waxes may be mentioned beeswax (natural bleached and natural yellow), synthetic beeswaxes, carnauba wax, paraffin wax, bayberry wax, synthetic microcrystalline wax, and various synthetic and natural ozokerite, Japan and ceresine waxes.

Preferred among the cationic agents are the quaternary ammonium salts which are useful because of their combing, detangling, softness, luster, and manageability benefits. They also provide excellent static fly-away benefits.

The nonionic agents which we have found useful include many of a wide variety of materials. Included are sorbitan esters, fatty alcohols, polyhydric alcohol esters, tertiary phosphine oxides, tertiary amine oxides, and ethoxylated alcohols, among others.

Specific teachings with respect to many of the materials which may be employed in the practice of our invention are found in U.S. Pat. No. 4,206,195, which, for that purpose, is included herein by reference.

The amount of hair treating agent in the reservoir layer, called the loading level, can range from 4 to 50 grams per square meter of substrate, with 6 to 45 grams being preferred. A loading level of hair treating agent below 4 grams is avoided because of a lack of noticeable benefits while a level above 50 grams is avoided because of the loss of favorable cosmetic hair conditioning attributes due to the excessive amount of treating agent transferred to the hair.

Impregnation or coating of the reservoir layer with the hair treating agent can be carried out in any convenient manner, many methods being known in the art. For example, the treating composition in liquid or solution form can be sprayed onto the reservoir substrate.

Another method of manufacture involves the printing of molten or a solution-form of hair treating agent onto the reservoir substrate. The level of agent applied is controlled by the proper selection of gravure printing roll. The freshly applied hair conditioning agent is solidified either by cooling or solvent evaporation.

EXAMPLE I

A piece of polyester polyurethane foam 90 mils in thickness with a flame bonded 0.92 mil poly ethylene terephthalate film was removed from a roll and slit cut to a width of 70 millimeters. The foam sleeve material with the bonded substrate was wrapped and pulled tight over a 0.75 inch diameter stainless steel mandrel. The sleeve material was then heat sealed (fused) at the overlap with a heated sealing implement. The resulting sleeve was examined for complete heat sealing and strength of the seal. The sleeve was then equilibrated at 70° F. (22° C.) and 55% R.H. and weighed. The sleeve was then placed over a cylindrical mandrel of 0.75 inch diameter with was rotated at 2 revolutions per minute.

A hair conditioning treatment formulation was prepared by dissolving 2.5 grams polyoxyethylene(20)cetyl ether, 2.5 grams fully refined paraffin wax, 2.5 grams polyethylene imine, MW 40,000–60,000), 2.5 grams natural beeswax (yellow) and 0.5 grams nonyl phenol (8) ethylene oxide in 369 grams of absolute ethyl alcohol-n-heptane mixture (1:1). This mixture was placed into a heated (35° C.) trough beneath the rotating foam sleeve. The foam sleeve was then immersed into the treatment solution to approximately 0.095 inches depth and allowed to rotate for one minute to ensure an even distribution of the conditioning materials on the foam substrate. The treatment bath was then removed and the excess solution allowed to drain from the sleeve. The rotating sleeve was then dried in a steady stream of heated air (136° C.). The sleeve was subsequently removed from the cylinder, allowed to equilibrate at 70° F. (22° C.) and 55% R.H., weighed to determine the loading level (12.5 grams per square meter of substrate) and cut into 10.0 centimeter lengths.

A similar sleeve was fabricated for the control experiment in which the sleeve prepared was identical to the above except that no conditioning treatment was used on the sleeve.

A standard conventional, commercially available, heated curling iron (heated section 0.75 inch diameter, 130° C. temperature) was allowed to equilibrate at its normal operating temperature before beginning any treatment. The curling iron was then maintained at this operating temperature during the entire curling procedure. The treated foam conditioning sleeve was then placed onto the barrel of the hot curling iron and allowed to equilibrate before proceeding to curl the hair.

Standard one gram, six inch long hair tresses that had been washed and conditioned at 70° F. (22° C.), 65% R.H. were used in this procedure. The hair tress was positioned on the curling iron and wrapped around the barrel once in the usual fashion. A 100 gram weight was applied to the tab end of the tress and maintained in that configuration for one minute. Subsequently, the weight was removed and the tress carefully removed from the curling iron and its length immediately recorded. The length of the tress was measured subsequently at 24 hours after treatment for loss of curl retention as a function of time at 70° F. (22° C.) and 65% R.H. The tress was also evaluated at this time for cosmetic and combing conditioning attributes.

A similar tress was treated in a manner identical to the above for the control experiment using the control sleeve prepared as previously described above.

The treated tress displayed a set improvement of 2.3 times that of the control and possessed superior conditioning properties and attributes such as improved combing (reduction of combing force and work), more lustrous, softer, more manageable and reduced fly-away when compared to the control tress. Further evaluation of the conditioner treated tress found that after the conditioning treatment the tress was not tacky, greasy, dull looking or limp; thereby, indicating that the conditioning treatment conditions the hair with no adverse attributes imparted to the tress.

EXAMPLES II–XI

In the following examples, hair conditioning sleeves similar to that described in Example I are prepared. The method of preparation, treating compositions and evaluation method of Example I is followed in each case.

| | Example II | Example III | Example IV | Example V | Example VI |
|---|---|---|---|---|---|
| Sleeve Materials | polyurethane/foam polyurethane skin barrier | polyester polyurethane foam/ polyethylene terephthalate barrier | polyester polyurethane foam/ polyethylene terephthalate barrier | polyester polyurethane foam/ polyethylene terephthalate barrier | polyester polyurethane foam/ polyethylene terephthalate barrier |
| Appliance Temperature | 130° C. | 130° | 150° | 130° | 130° |
| Hair Conditioner Loading level $g/m^2$ | 9.4 | 23.5 | 23.5 | 41.0 | 7.3 |
| Set Improvement (ratio treatment/control) | 2.6 | 3.0 | 4.6 | 3.5 | 2.5 |

| | Example VII | Example VIII | Example IX | Example X | Example XI |
|---|---|---|---|---|---|
| Sleeve Materials | polyester polyurethane foam/ polyethylene terephthalate barrier | polyester polyurethane foam/ polyethylene terephthalate barrier | polyether polyurethane foam/ Flex-Can ® II barrier (polypropylene, aluminum foil, poly(ethylene-terephthalate) | polyether polyurethane foam/ EVA, aluminum foil, polyethylene, paper barrier | non-woven polyester/ Polyethylene terephthalate barrier |
| Appliance Temperature | 130° C. | 130° | 130° | 130° | 130° |
| Hair Conditioner Loading Level $g/m^2$ | 21.9 | 21.9 | 12.5 | 12.5 | 10.4 |
| Set Improvement (ratio treatment/ | 2.8 | 2.8 | 2.3 | 2.4 | 2.1 |

-continued control)

The articles described in the examples above, when used to condition the hair with the heating appliance, make the hair more lustrous, softer, easier to comb, more manageable and reduce fly-away while imparting no adverse attributes.

While particular embodiments of the invention have been described, it will be apparent to those skilled in the art that variations may be made thereto without departing from the spirit of the invention and the scope of the appended claims.

What is claimed is:

1. A flexible tubular sleeve for use in conjunction with a source of heat for the application of a treating composition to the hair, said sleeve comprising an inner layer of a liquid impermeable material and an outer reservoir layer, said reservoir layer being impregnated with a hair treating composition having a melting point of about 22°–100° C.

2. A flexible tubular sleeve as described in claim 1 in which the layer of liquid impermeable material comprises a material selected from the class consisting of synthetic polymer films, metal foils, and papers having a heat sealed synthetic polymer coating.

3. A flexible tubular sleeve as described in claim 1 in which the layer of liquid impermeable material is formed by sealing the surface of the material which forms the outer reservoir layer.

4. A flexible tubular sleeve as described in claim 1 in which the outer reservoir layer is made from a material selected from the class consisting of cloth substrates and flexible, cellular, synthetic polymer foams.

5. A flexible tubular sleeve as described in claim 1 in which the hair treating composition is a material selected from the class consisting of waxes and cationic, nonionic, anionic, zwitterionic, and amphoteric surface active agents.

6. A flexible tubular sleeve as described in claim 1 in which the loading level of the hair treating composition is from about 4 to about 50 grams per square meter.

7. A flexible tubular sleeve for use in conjunction with the source of heat for the application of a treating composition to the hair, said sleeve having an inside diameter of about 12–38 mm., a length of 3–15 cm. and comprising an inner layer of a liquid impermeable material and an outer reservoir layer, said inner layer comprising a material selected from the class consisting of synthetic polymer films, metal foils, and papers having a heat sealed synthetic polymer coating, and said outer reservoir layer having a thickness of about 2–250 mils comprising a material selected from the class consisting of cloth substrates and flexible, cellular, synthetic polymer foams, said outer reservoir layer being impregnated with about 4 to about 50 grams per square meter of a hair treating composition having a melting point of about 22°–100° C. and being selected from the class consisting of waxes and cationic, nonionic, anionic, zwitterionic, and amphoteric surface active agents.

* * * * *